US010588476B2

(12) United States Patent
Royale et al.

(10) Patent No.: US 10,588,476 B2
(45) Date of Patent: Mar. 17, 2020

(54) SELF-CLEANING FEATURES FOR EXTRACTION CLEANERS

(71) Applicant: BISSELL Homecare, Inc., Grand Rapids, MI (US)

(72) Inventors: Victoria J. Royale, Charlotte, MI (US); Aaron P. Griffith, Grand Rapids, MI (US); David M. Miller, Zeeland, MI (US); Michael Luyckx, Ada, MI (US); Brian C. Wolfe, Kalamazoo, MI (US); Justin Benacquisto, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 16/152,042

(22) Filed: Oct. 4, 2018

(65) Prior Publication Data

US 2019/0104906 A1 Apr. 11, 2019

Related U.S. Application Data

(60) Provisional application No. 62/568,956, filed on Oct. 6, 2017.

(51) Int. Cl.

| | |
|---|---|
| ***A47L 11/40*** | (2006.01) |
| ***A47L 11/20*** | (2006.01) |
| ***A47L 11/30*** | (2006.01) |
| ***A47L 11/34*** | (2006.01) |

(52) U.S. Cl.

CPC ..... *A47L 11/4016* (2013.01); *A47L 11/201* (2013.01); *A47L 11/30* (2013.01); *A47L 11/302* (2013.01); *A47L 11/34* (2013.01); *A47L 11/4088* (2013.01); *A47L 11/4094* (2013.01)

(58) Field of Classification Search

CPC ..... A47L 7/0004; A47L 9/242; A47L 11/34; A47L 11/40

See application file for complete search history.

(56) References Cited

U.S. PATENT DOCUMENTS

| | | | | |
|---|---|---|---|---|
| 4,083,077 | A | 4/1978 | Knight et al. | |
| 4,159,554 | A | 7/1979 | Knight et al. | |
| 6,073,300 | A * | 6/2000 | Zahuranec | A47L 11/34 15/320 |
| 7,784,148 | B2 * | 8/2010 | Lenkiwicz | A47L 9/0036 15/322 |
| 10,188,252 | B2 * | 1/2019 | Nguyen | A47L 11/20 |
| 2005/0015916 | A1 | 1/2005 | Orubor | |
| 2017/0127900 | A1 | 5/2017 | Wright et al. | |

FOREIGN PATENT DOCUMENTS

| | | |
|---|---|---|
| EP | 0688530 A1 | 6/1995 |
| GB | 2334668 A | 9/1999 |

OTHER PUBLICATIONS

European extended Search Report for 18198219.0, dated Mar. 13, 2019.

* cited by examiner

*Primary Examiner* — Michael D Jennings
(74) *Attorney, Agent, or Firm* — McGarry Bair PC

(57) ABSTRACT

Self-cleaning features for extraction cleaners and attachments for extraction cleaners, such as accessory tools, wands, and/or hoses, are provided. The self-cleaning features are configured redirect cleaning fluid from a fluid supply system of the extraction cleaner into a working air or fluid recovery path of the extraction cleaner, including, but not limited to into the working air or fluid recovery path of a tool, wand, and/or hose of the extraction cleaner.

15 Claims, 14 Drawing Sheets

SELF-CLEANING FEATURES FOR EXTRACTION CLEANERS

CROSS-REFERENCE TO RELATED APPLICATION

This application claims the benefit of U.S. Provisional Patent Application No. 62/568,956, filed Oct. 6, 2017, which is incorporated herein by reference in its entirety.

BACKGROUND

Extraction cleaners are well-known surface cleaning apparatuses for deep cleaning carpets and other fabric surfaces, such as upholstery. Most extraction cleaners, or deep cleaners, comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Some extraction cleaners for household use attachments, such as hoses, wands, and other cleaning tools to perform cleaning operations. The hoses, wands, and other cleaning tools may be configured for both fluid delivery and fluid recovery.

BRIEF DESCRIPTION

In one aspect, the disclosure relates to a system for cleaning a recovery path of an extraction cleaner having a fluid delivery system with a supply container and a recovery system comprising at least a suction source and a recovery container. The system includes a wand comprising a fluid delivery pathway adapted for fluid communication with the supply container and having a fluid connector, an airflow pathway adapted for fluid communication with the recovery container having an airflow connector, and a wand cap adapted to partially receive the wand. The wand cap includes a fluid connector receiver that mates with the fluid connector of the wand, an airflow connector receiver that mates with the airflow connector of the wand, and an enclosed pathway between the fluid connector receiver and the airflow connector receiver.

In another aspect, the disclosure relates to an accessory for an extraction cleaner having a fluid delivery system comprising a supply container and a recovery system comprising at least a suction source and a recovery container. The accessory includes a housing, an airflow pathway extending through the housing between an air inlet and an air outlet, wherein the air outlet is configured for fluid communication with the recovery container, a fluid delivery pathway extending through the housing between a fluid inlet and a fluid outlet, wherein the fluid inlet is configured for fluid communication with the supply container, and a diverter provided on the housing in the fluid delivery pathway upstream of the fluid outlet and configured to divert cleaning fluid into the airflow pathway downstream of the air inlet and upstream of the air outlet.

DETAILED DESCRIPTION

The disclosure generally relates to features and improvements for extraction cleaners for floor surfaces that have fluid delivery and recovery capabilities. In particular, the features and improvements relate to cleaning and maintaining such extraction cleaners. Embodiments disclosed herein relate more specifically to self-cleaning features incorporated into accessory tools, wands, and/or hoses for cleaning the fluid recovery systems of extraction cleaners.

Some aspects of the present disclosure relate to a wand end cap for containing and directing cleaning fluid into the working air path of a wand to flush out the wand and the downstream fluid recovery path, including, but not limited to an accessory hose and recovery tank.

Some aspects of the present disclosure relate to an extraction cleaner with a wand receiver provided thereon for receiving a wand, where the wand receiver is configured to contain and direct cleaning fluid into the working air path of a wand to flush out the wand and the downstream fluid recovery path, including, but not limited to an accessory hose and recovery tank.

Some aspects of the present disclosure relate to a self-cleaning accessory tool configured to selectively divert cleaning fluid into a working air path of the accessory tool to flush out the accessory tool, and the downstream fluid recovery path, including, but not limited to a wand, an accessory hose, and/or recovery tank.

Some aspects of the present disclosure relate to a self-cleaning wand configured to selectively divert cleaning fluid into a working air path of the wand to flush out the wand and the downstream fluid recovery path, including, but not limited to an accessory hose and recovery tank.

Some aspects of the present disclosure relate to an adapter coupling which can, for example, be coupled intermediately between two attachments, such as a wand, an accessory tool, or a hose, and is configured to selectively divert cleaning fluid into a working air path of at least some of the attachments to flush out the attachments, and the downstream fluid recovery path.

Figure 1:
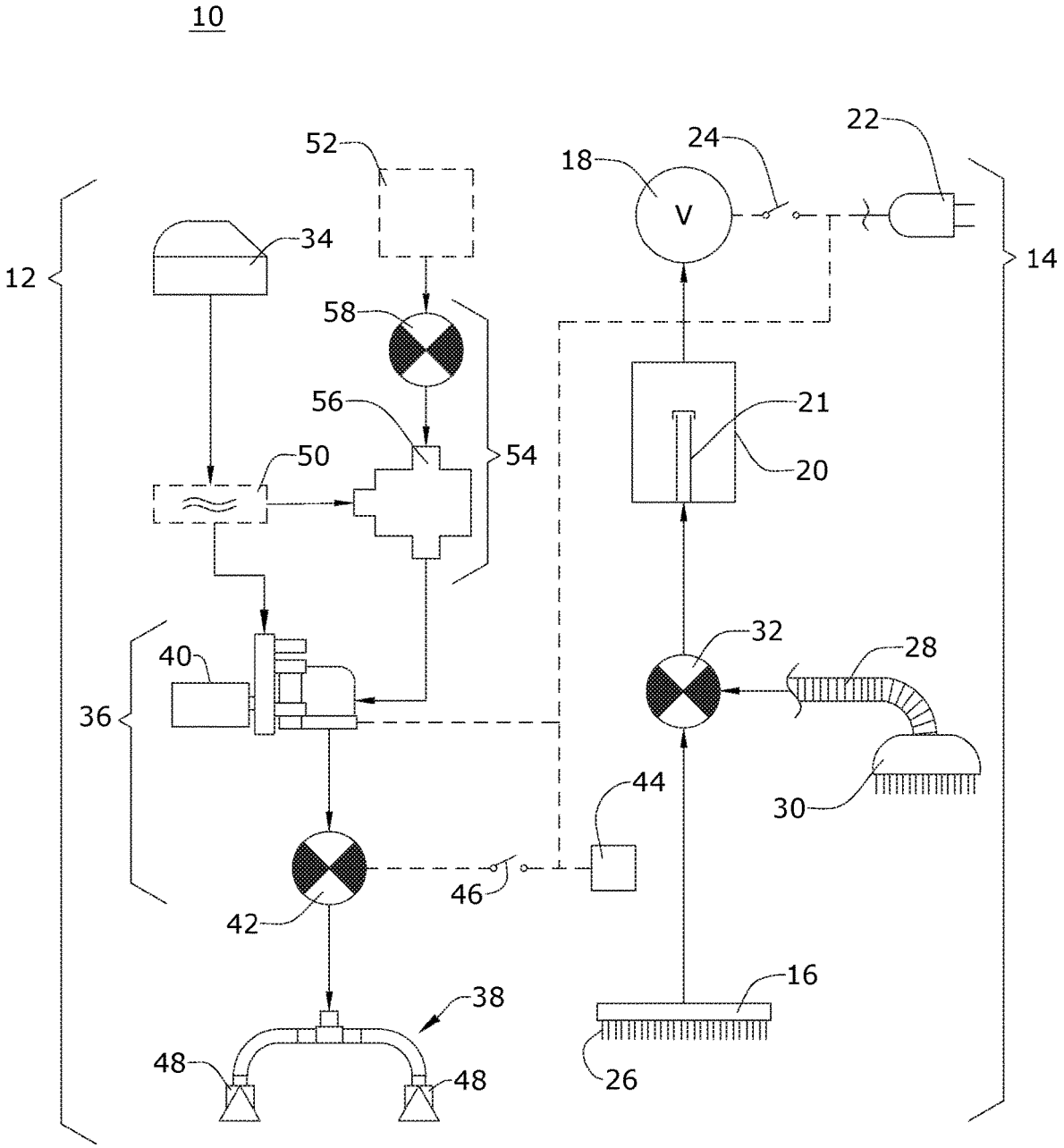
FIG. 1 is a schematic view of an extraction cleaner.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, an autonomous or robotic extraction cleaner, or a commercial extractor. Any of the aforementioned extraction cleaners can be adapted to include one or more attachments, such as a flexible vacuum hose, which can form a portion of the working air conduit between a nozzle and the suction source. Such a vacuum hose can be coupled with additional attachments, such as a wand and/or accessory tool.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source such as a motor/fan assembly 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The motor/fan assembly 18 is provided in fluid communication with the recovery container 20. The motor/fan assembly 18 can be electrically coupled to a power source 22, such as a battery or by a power cord plugged into a household electrical outlet. A suction power switch 24 between the motor/fan assembly 18 and the power source 22 can be selectively closed by the user, thereby activating the motor/fan assembly 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with one or more attachments. An accessory hose 28 can be selectively fluidly coupled to the motor/fan assembly 18 for cleaning using an accessory tool or cleaning tool 30 with a separate suction inlet. A diverter assembly 32 can selectively divert fluid communication between the motor/fan assembly 18 and either the suction nozzle 16 or the accessory hose 28. The accessory hose 28 can also comprise a fluid distributor (not shown) in communication with the fluid delivery system 12 to selectively deliver cleaning fluid to the surface to be cleaned.

The fluid delivery system 12 can include at least one fluid container 34 for storing a supply of cleaning fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the container 34 to at least one fluid distributor 38. In one configuration, the flow control system 36 can comprise a pump 40 which pressurizes the system 12 and a flow control valve or valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In another example, the pump 40 can be a solenoid pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple distributor outlets 48 can also be provided. As illustrated in FIG. 1, the distributor outlets 48 can comprise multiple spray tips which distribute cleaning fluid to the surface to be cleaned. The cleaning tool 30 can optionally include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the fluid container 34 and upstream of the pump 40. Other types of heaters 50 can also be used. In yet another example, the cleaning fluid can be heated using exhaust air from a motor-cooling pathway for the motor/fan assembly 18.

As another option, the fluid delivery system 12 can be provided with a second container 52 for storing a cleaning fluid. For example, the fluid container 34 can store water and the second container 52 can store a cleaning fluid. The containers 34, 52 can, for example, be defined by a supply tank and/or a collapsible bladder. In one configuration, the fluid container 34 can be a bladder that is provided within the recovery container 20. Alternatively, a single container can define multiple chambers for different fluids. The cleaning fluid in either container 34, 52 can include, but is not limited to, water or a mixture including water and one or more treating agents. Treating agents can include, but are not limited to, detergents, odor eliminators, sanitizers, stain removers, odor removers, deodorizers, fragrances, or any combination thereof.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the extraction cleaner 10 is prepared for use by coupling the extraction cleaner 10 to the power source 22, and by filling the fluid container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the motor/fan assembly 18 prior to being exhausted from the extraction cleaner 10. The recovery container 20 can be periodically emptied of collected fluid and debris.

Additional details of suitable extraction cleaners are disclosed in U.S. Pat. No. 7,784,148, issued Aug. 31, 2010, and in U.S. Pat. No. 10,188,252, issued Jan. 29, 2019, both of which are incorporated herein by reference in their entirety.

It is noted that in other embodiments of the extraction cleaner 10, the suction nozzle 16 and associated fluid recovery flow path components can be eliminated, and the extraction cleaner 10 can have only the accessory hose 28 and cleaning tool 30 for recovering cleaning fluid. Also optionally, the distributor outlet 48 and associated fluid delivery flow path components can be eliminated, and the extraction cleaner 10 can have only the accessory hose 28 and cleaning tool 30 for delivering cleaning fluid.

Figure 2:
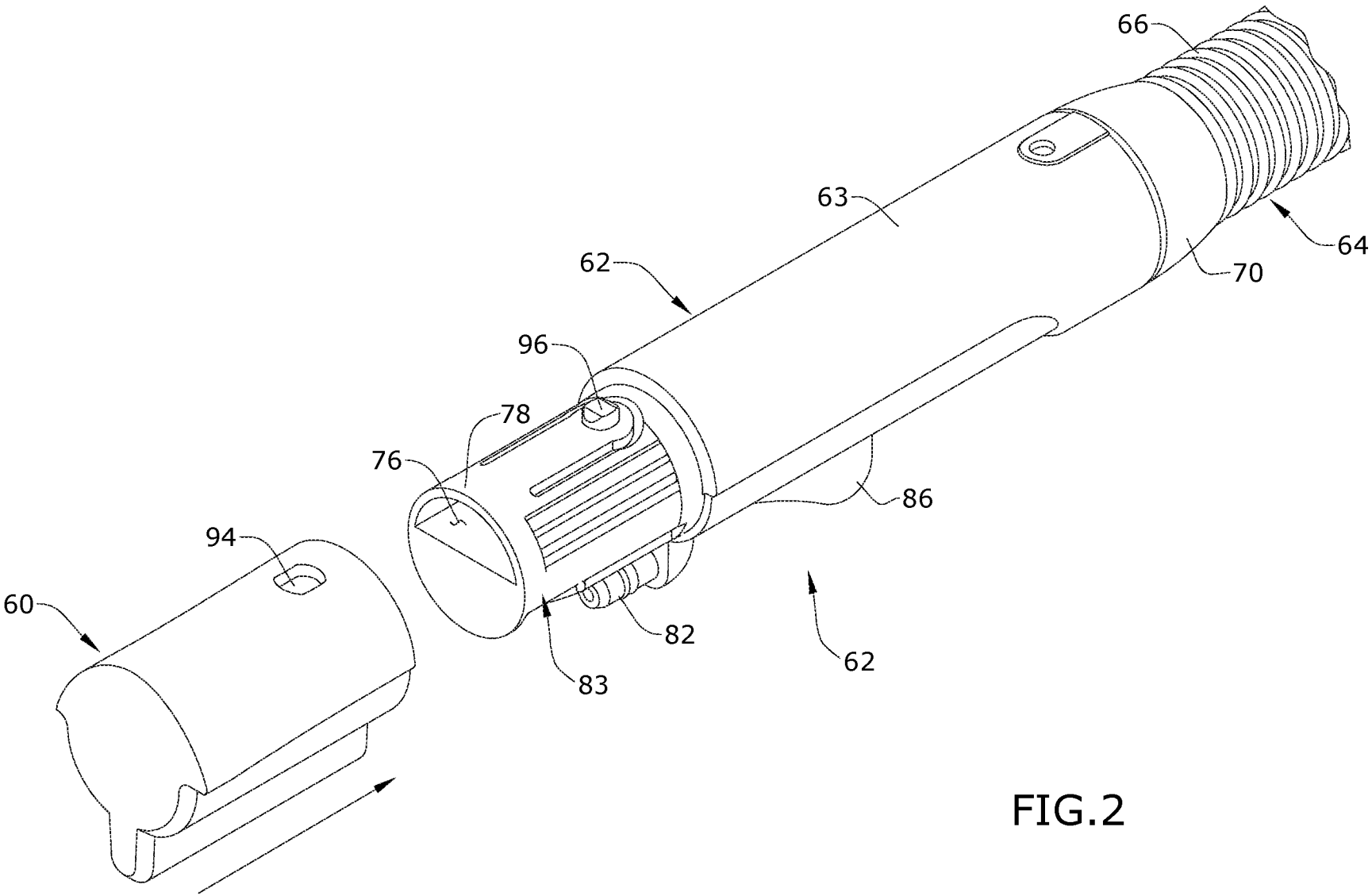
FIG. 2 is a perspective view of a wand cap for a wand and accessory hose of an extraction cleaner, according to a first aspect of the present disclosure.
Figure 3:
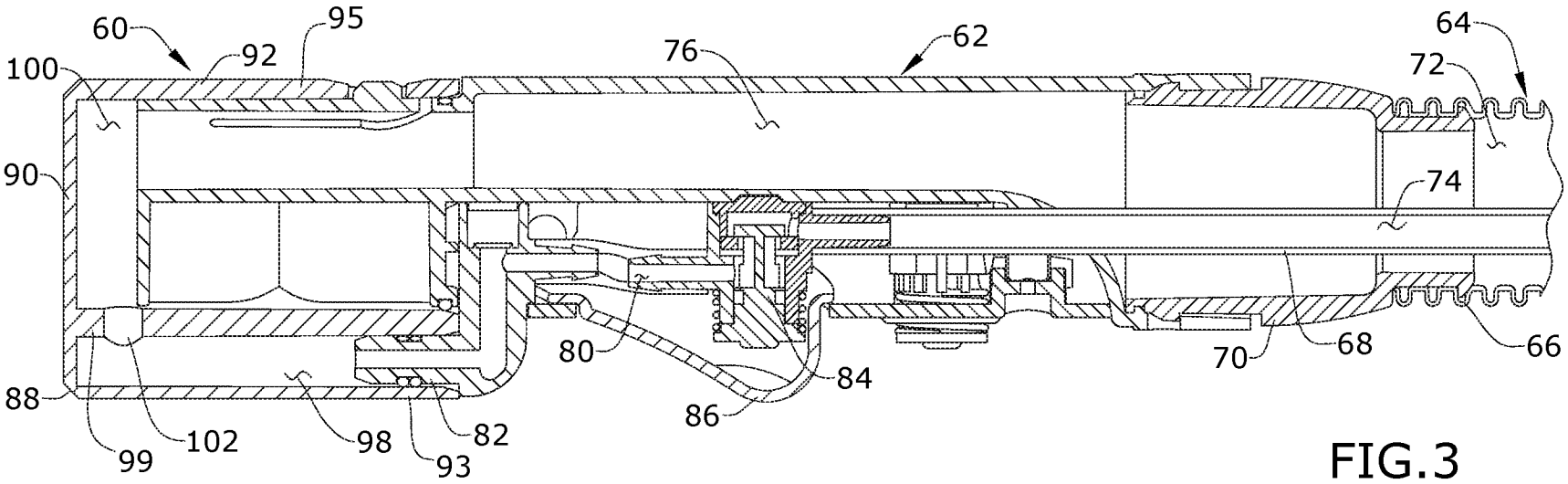
FIG. 3 is a sectional view through the wand cap of FIG. 2, assembled with the wand and accessory hose.

FIGS. 2-3 show one embodiment of a system for cleaning a recovery path of an extraction cleaner, such as the extraction cleaner 10 of FIG. 1. The system can comprise a wand 62 and a hose or accessory hose 64. A wand cap 60 for cleaning the wand 62 and accessory hose 64 can also be included in the system. The wand cap 60 is adapted to partially receive the wand and can be assembled to the wand 62 and accessory hose 64, by inserting the wand cap 60 onto the end of the wand 62 in the direction indicated by the arrow in FIG. 2. The wand cap 60 is configured to clean the wand 62 by guiding and re-directing cleaning fluid from the fluid distributor of the wand into a working air path of the wand 62 to flush out the wand 62, accessory hose 64 and downstream components of the recovery system 14. The wand cap 60 can be configured to fit any standard extractor wand. In the context of the extraction cleaner 10 of FIG. 1, the accessory hose 64 can be used as accessory hose 28 and the wand 62 can be used as cleaning tool 30.

The accessory hose 64 includes a flexible hose conduit 66, a flexible fluid delivery conduit 68, a hose coupler (not shown) at one end of the flexible hose conduit 66 which couples to the extraction cleaner 10 (FIG. 1) to place the accessory hose 64 in fluid communication with the fluid delivery system 12 and recovery system 14, and a tool coupler 70 at the opposite end of the flexible hose conduit 66 for selectively coupling an accessory tool, such as the wand 62 shown in FIG. 2. The tool coupler 70 defines an inlet end of the accessory hose 64. Only a portion of the length of the flexible hose conduit 66 is shown in FIG. 3 for clarity, as indicated by the break lines.

The flexible hose conduit 66 can define an airflow pathway 76 and can house the flexible fluid delivery conduit 68 therein. Alternatively, the flexible fluid delivery conduit 68 can extend externally to the airflow pathway 76. In the context of the extraction cleaner 10 of FIG. 1, the airflow pathway 76 is configured to be coupled with the recovery container 20, and the flexible fluid delivery conduit 68, which defines a fluid delivery pathway 74, is configured to be coupled with at least the fluid container 34.

The wand 62 includes a wand housing 63 with an airflow connector 78 defining an inlet to an airflow pathway 76, which is fluidly coupled to the airflow pathway 72 of the flexible hose conduit 66. The wand 62 further comprises a fluid connector 82 defining the outlet end of a fluid delivery pathway 80, which is fluidly coupled with the fluid delivery pathway 74 of the flexible fluid delivery conduit 68. A valve 84 can be provided in the fluid delivery pathway 80 for controlling the flow of cleaning fluid to the fluid connector 82. The valve 84 can be controlled by the user via a valve actuator, such as a trigger 86 provided on the wand housing 63.

The airflow connector 78 defines an inlet end of the wand 62, and the airflow connector 78 and fluid connector 82 collectively define a wand tool coupler 83 adapted to selectively couple a cleaning tool 30 to the wand 62.

The wand cap 60 fits on the free end of the wand 62, i.e. the wand tool coupler 83, and creates an enclosed pathway between the fluid connector 82 and the airflow connector 78.

As shown, the wand cap 60 can have a cup-shaped cap housing 88 configured to mate with the free end of the wand 62, and can include a closed end wall 90 and a peripheral side wall 92 extending from the closed end wall 90 to an open opposite end. The peripheral side wall 92 can fit snugly on the wand tool coupler 83, with the closed end wall 90 spaced from the inlet end of the wand 62 so as not to seal the wand inlet and to allow working air to flow from within the wand cap 60 through the airflow pathway 76 when the wand cap 60 is installed. The cap housing 88 can optionally have an opening 94 configured to receive a detent 96 on the airflow connector 78 for selectively attaching the wand cap 60 on the wand 62.

The peripheral side wall 92 can at least partially define a fluid connector receiver 93 that mates with the fluid connector 82 as well as an airflow connector receiver 95 that mates with the airflow connector 78 on the wand 62. The cap housing 88 also includes a first internal fluid channel 98 and a second internal fluid channel 100 in fluid communication with the fluid connector receiver 93 and airflow connector receiver 95, respectively. At least one passage opening 102 is provided in a wall 99 separating the two internal fluid channels 98, 100 for guiding fluid flow from the fluid connector 82 into the airflow pathway 76 of the wand 62 when the wand cap 60 is installed. The passage opening 102 and second internal fluid channel 100 directs the flow of cleaning liquid upwardly through the cap housing 88, into the inlet of the airflow pathway 76 of the wand 62. At least one air gap (not shown) can be provided within the housing to allow working air to flow into the wand inlet when the end cap is installed.

In operation, to clean and rinse the recovery path of the extraction cleaner, a user can install the wand cap 60 on the wand 62 and depress the trigger 86. Cleaning fluid flows from the fluid connector 82 through the internal fluid channels 98, 100 and through the working air inlet in airflow connector 78 and downstream working air path, including through airflow pathway 76 and airflow pathway 72 of the accessory hose 64. Delivering cleaning fluid directly into the wand 62 flushes away debris, residue and odor-causing bacteria in the wand 62, and in the accessory hose 64, which can be present after normal use. The soiled fluid is deposited into the recovery container 20 which can be periodically emptied of collected fluid and debris.

Figure 4:
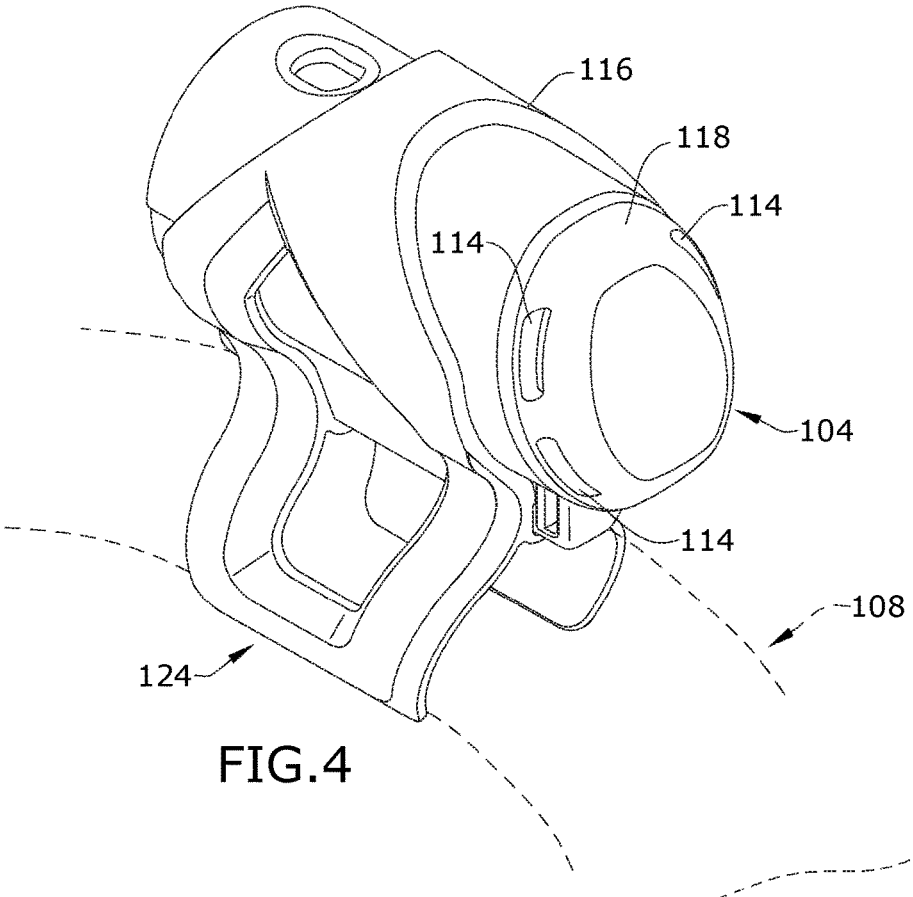
FIG. 4 is a perspective view of a wand cap for a wand and accessory hose of an extraction cleaner, according to a second aspect of the present disclosure.
Figure 5:
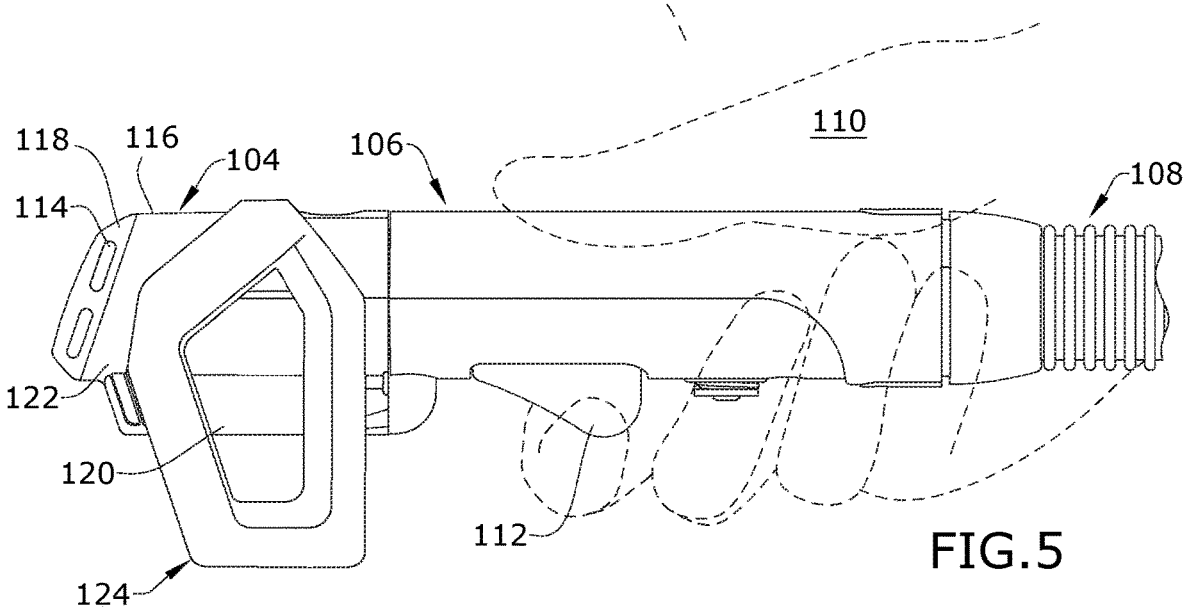
FIG. 5 is a side view of the wand cap of FIG. 4, assembled with a wand and accessory hose of an extraction cleaner.

FIGS. 4-5 show a second embodiment of the system with a wand cap 104 for cleaning an extractor wand or wand 106 and accessory hose 108 of an extraction cleaner. The wand cap 104 is configured to clean the wand 106 by containing and directing cleaning fluid into a working air path of the wand 106 to flush out the wand 106 and the accessory hose 108. The wand cap 104 can be configured to fit any standard extractor wand. In the context of the extraction cleaner 10 of FIG. 1, the accessory hose 108 can be used as accessory hose 28 and the wand 106 can be used as cleaning tool 30. In FIG. 4, the wand cap 104 is shown as being stored on the accessory hose 108, while in FIG. 5, the wand cap 104 is shown as being assembled with the wand 106 and accessory hose 108, and a user's hand 110 is shown in phantom line indicating how the wand 106 may be held to operate the trigger 112.

The wand cap 104 can be substantially similar to the wand cap 60 of FIGS. 2-3, save for having air vents 114 in the cap housing 116, such as in the front portion of the side wall 118, for allowing working air to flow into the wand inlet when the wand cap 104 is installed. Furthermore, at least a portion of the cap housing 116 can be transparent; for example, at least a portion of one or both of first and second internal fluid channels 120, 122 can be transparent for the user to view cleaning fluid flowing back into the wand 106. Still further, the wand cap 104 can be provided with a hose clip 124 configured to clip or mount onto the accessory hose 108 for storage when the wand cap 104 is not installed on the wand 106, as shown in FIG. 4. Otherwise, the structure and function of the wand cap 104 is substantially similar to wand cap 60.

Figure 6A:
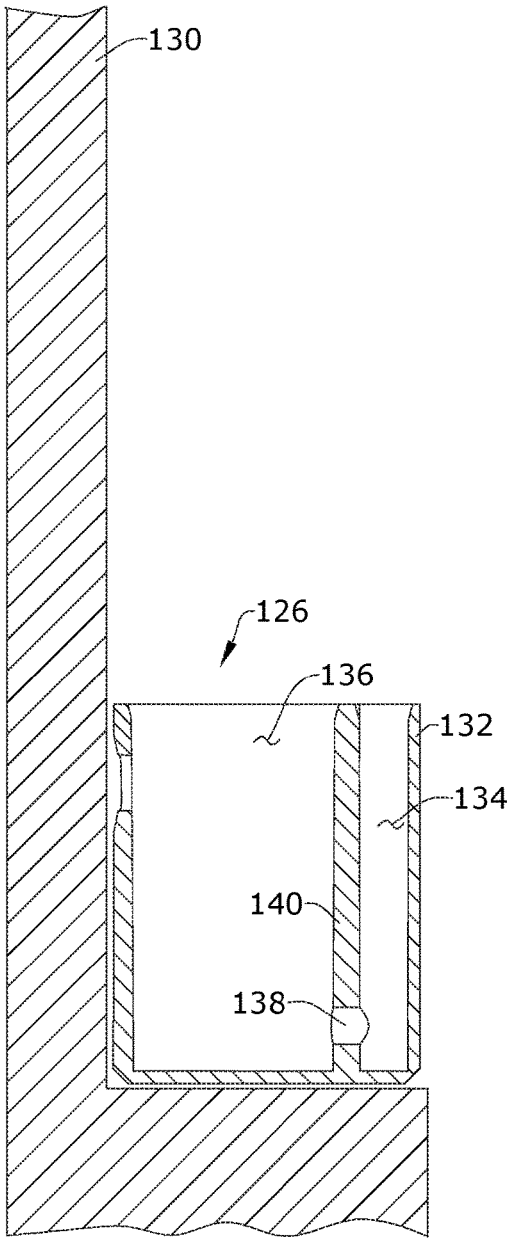
FIG. 6A is a sectional view through a wand receiver provided on an extraction cleaner for a wand, according to a third aspect of the present disclosure.
Figure 6B:
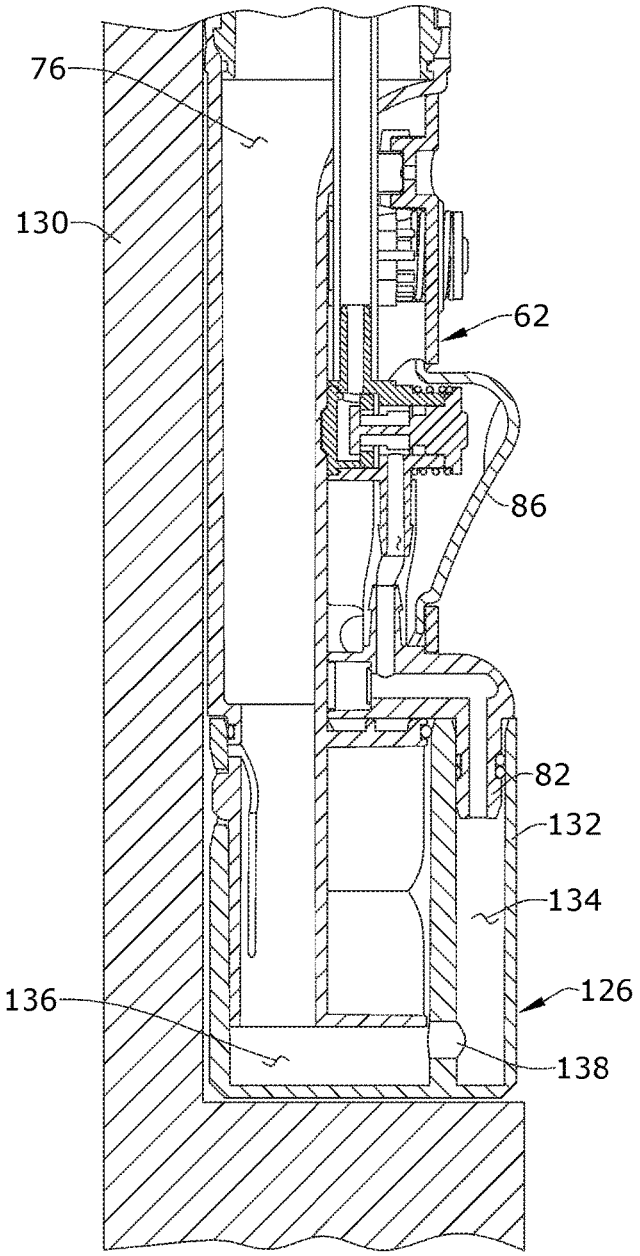
FIG. 6B is a sectional view similar to FIG. 6A, showing a wand coupled with the wand receiver.
Figure 7:
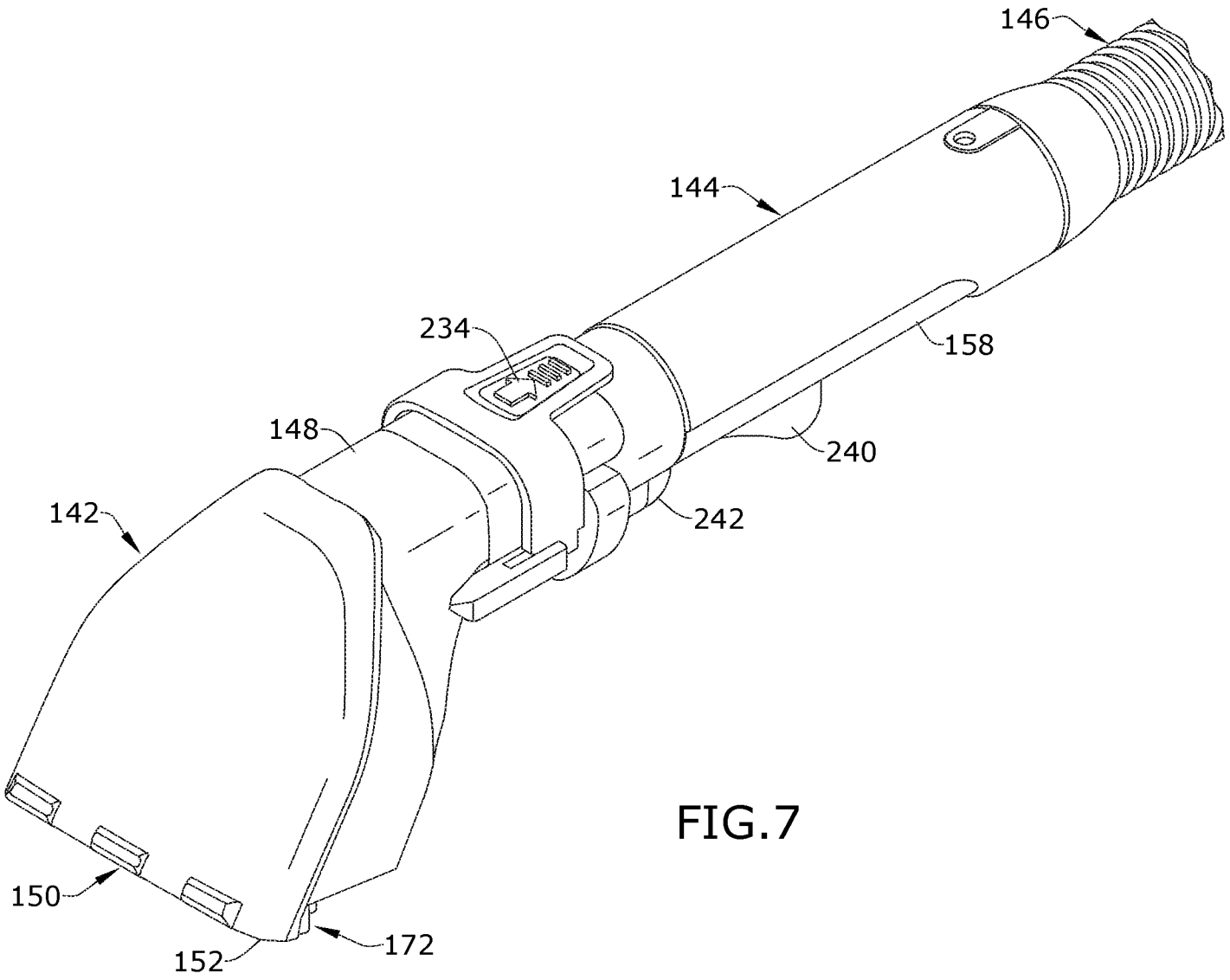
FIG. 7 is a perspective view of an accessory tool for an extraction cleaner, according to a fourth aspect of the present disclosure.
Figure 8:
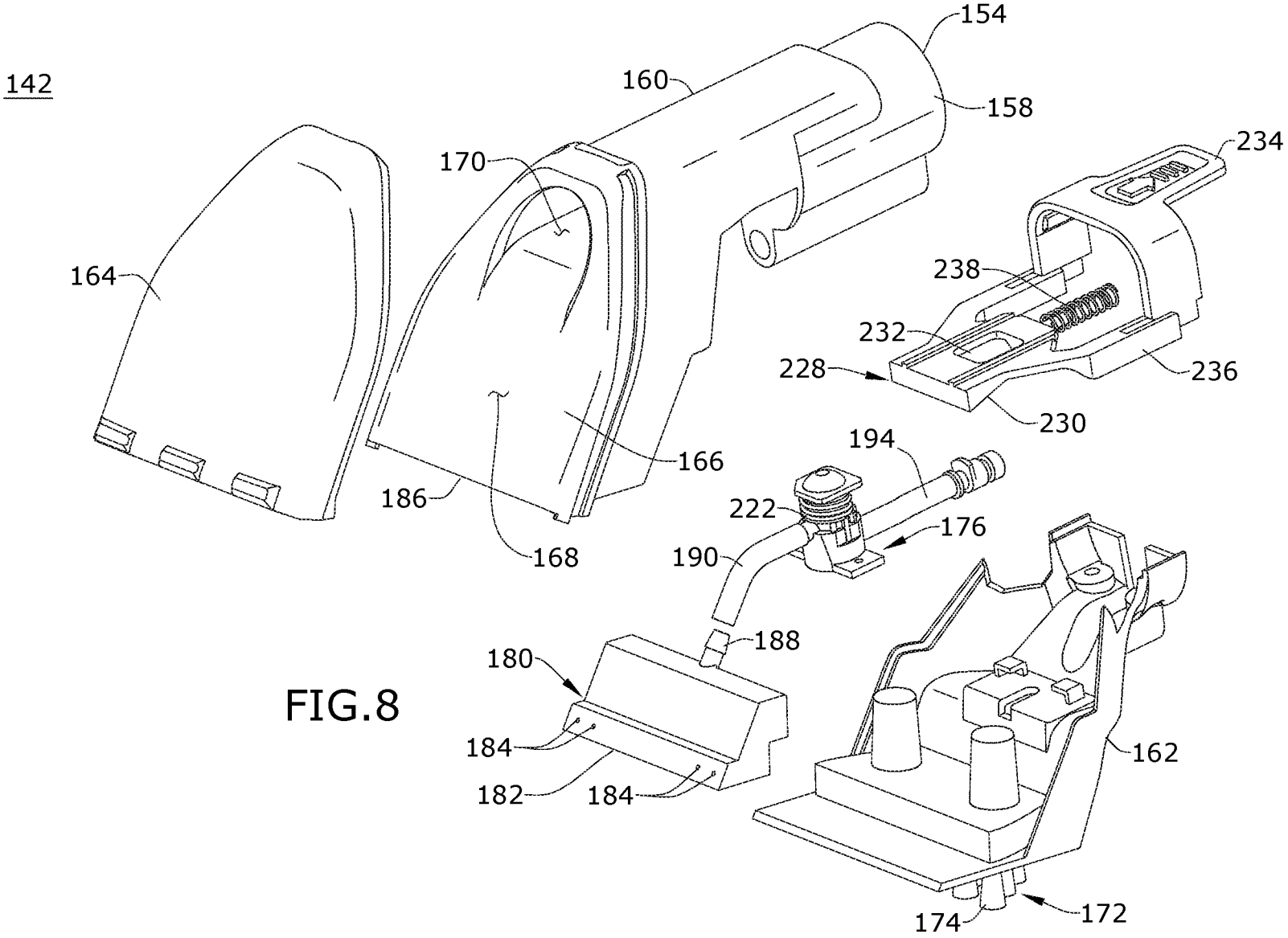
FIG. 8 is an exploded view of the accessory tool of FIG. 7.

FIGS. 6A-6B show a wand receiver 126 provided on an extraction cleaner, such as the extraction cleaner 10 (FIG. 1), for storing and cleaning a wand and downstream recovery path of the extraction cleaner according to a third embodiment of the system. In the illustrated example, the extraction cleaner 10 can be included in the system, wherein a wand cap is provided on a housing of the extraction cleaner 10.

The wand 62 described above with reference to FIG. 2 is shown assembled with the wand receiver 126 in FIG. 6B, with the wand 62 being stored within the wand receiver 126. The wand receiver 126 is configured to clean the wand 62 by containing and directing cleaning fluid into a working air path of the wand 62 to flush out the wand 62, and the downstream recovery path, which comprises at least an accessory hose, for example, such as the accessory hose 64 (FIG. 2). The wand receiver 126 can be configured to receive any standard extractor wand.

The wand receiver 126 includes a wand receiver housing 132 provided on a portion of a housing 130 of the extraction cleaner 10, and can comprise geometry that is substantially similar to the embodiments of the wand cap 60, 104 described above with reference to FIGS. 2-3 and FIGS. 4-5. The wand receiver housing 132 is configured to receive the free end of the wand 62, i.e. the wand tool coupler 83, and creates an enclosed pathway between the fluid connector 82 and the airflow connector 78 of the wand 62. As shown, the wand receiver housing 132 can comprise a first internal fluid channel 134 that mates with the fluid connector 82 on the wand 62 and a second internal fluid channel 136 that mates with the airflow connector 78 on the wand. At least one passage opening 138 is provided in a wall 140 separating the two internal fluid channels 134, 136 and allows fluid to flow from the fluid connector 82 into the airflow pathway of the wand 62 when the wand 62 is installed on the wand receiver 126. The passage opening 138 and second internal fluid channel 136 directs the flow of cleaning liquid laterally through the wand receiver housing 132 and into the inlet of the airflow pathway 76 of the wand 62. At least one air gap or leak (not shown) can be provided within the wand receiver 126 to allow working air to flow into the wand inlet when the wand 62 is installed on the wand receiver 126.

In operation, to clean and rinse the recovery path of the extraction cleaner, a user can install the wand 62 into the wand receiver 126, as shown in FIG. 6B, and depress the trigger 86. Cleaning fluid flows from the fluid connector 82, through the internal fluid channels 134, 136 and through the working air inlet in airflow connector 78 and downstream working air path, including through the airflow pathway 76 of the wand 62 and airflow pathway 72 of the accessory hose 64. Delivering cleaning fluid directly into the wand 62 flushes away debris, residue and odor-causing bacteria present in the wand 62, and in the accessory hose 64, which can be present after normal use.

FIGS. 7-12 show an embodiment of an accessory for an extraction cleaner, such as the extraction cleaner 10 of FIG. 1. In one example, the accessory comprises an accessory cleaning tool or accessory tool 142 that can be selectively fluidly connected to a wand 144 and an accessory hose 146, as shown. In the context of the extraction cleaner 10 of FIG.

1, the accessory tool 142 can be used as cleaning tool 30. The accessory tool 142 is configured to self-clean by selectively diverting cleaning fluid into a working air path of the accessory tool 142 to flush out the accessory tool 142, and downstream fluid recovery path, including wand 144 and/or accessory hose 146, for example.

The accessory tool 142 comprises a main housing 148 with a suction nozzle 150 at a forward portion of the main housing 148 defining a suction nozzle inlet 152, and an air outlet 154 at a rearward portion of the main housing 148 that is shown as being fluidly connected to a wand 144 and accessory hose 146 of an extraction cleaner to draw a working airflow through an airflow pathway 156 of the accessory tool 142 defined in the main housing 148 extending between the working air inlet, i.e. the suction nozzle inlet 152, and the air outlet 154. The airflow pathway 156 can be at least partially defined by a conduit 158 forming a handle grip for holding the accessory tool 142. The suction nozzle inlet 152 can be defined by an elongate, narrow, rectangular opening to generate high velocity airflow into the accessory tool 142.

In the illustrated embodiment, the main housing 148 includes a multi-part housing, including an upper housing body 160, a lower housing body 162, and a nozzle cover 164. Other configurations of the main housing 148 are also possible.

The suction nozzle 150 can be defined between the nozzle cover 164 and upper housing body 160. In the illustrated embodiment, the suction nozzle 150 is further defined by a front wall 166 of the upper housing body 160, which is spaced rearward from the nozzle cover 164. The space between the nozzle cover 164 and the front wall 166 forms a suction nozzle passage 168 which extends from the suction nozzle inlet 152 to a forward inlet opening 170 to the conduit 158 forming the handle grip, and forms part of the working airflow pathway through the accessory tool 142.

An agitator 172 can be provided on the main housing 148; as shown, the agitator 172 is located rearward of the suction nozzle 150 on the lower housing body 162. As shown in the illustrated embodiment, the agitator 172 can comprise a plurality of bristles 174. The bristles 174 can be bundled together in tufts to provide the desired stiffness and durability for agitation.

The fluid delivery pathway of the accessory tool 142 includes a diverter valve 176, such as a plunger valve, configured to selectively divert fluid through either a main fluid distributor 178 or through a rinse manifold 180. The main fluid distributor 178 delivers the cleaning fluid to the surface to be cleaned, and the rinse manifold 180 bypasses the main fluid distributor 178 and delivers the cleaning fluid directly to the suction nozzle 150 without first being applied to the surface, so that cleaning fluid is used to flush out the accessory tool 142, and also the downstream fluid pathway such as the wand 144 and accessory hose 146, for example.

In the illustrated embodiment, the rinse manifold 180 is a spray bar 182 having multiple manifold outlets 184 mounted in fluid connection with the suction nozzle 150. The front wall 166 of the upper housing body 160 can include a manifold opening 186 at a lower end thereof which is in substantial alignment with the rinse manifold 180 so that the manifold outlets 184 are exposed to airflow pathway 156 and can spray directly into the suction nozzle 150 through the manifold opening 186. The spray bar 182 can define a hollow interior or chamber, and can have a fluid connector 188 in fluid communication with the hollow interior or chamber and which is coupled with the diverter valve 176 by a conduit 190.

In operation, when fluid is selectively diverted through the rinse manifold 180, it flows into a lower end of the suction nozzle 150 near the suction nozzle inlet 152, is entrained in the working air stream, and rinses the suction nozzle 150 and downstream working air path.

Figure 9:
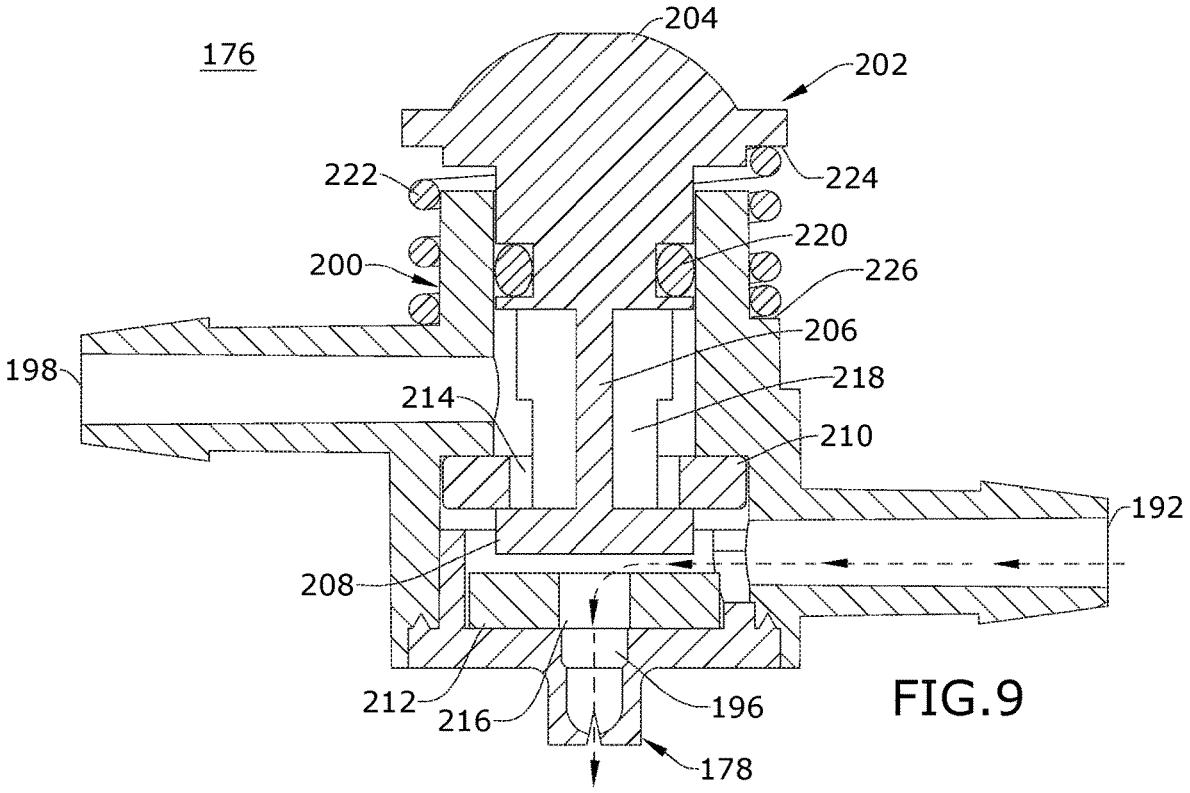
FIG. 9 is a sectional view through a valve assembly of the accessory tool of FIG. 7, showing the valve assembly in a surface cleaning mode.
Figure 10:
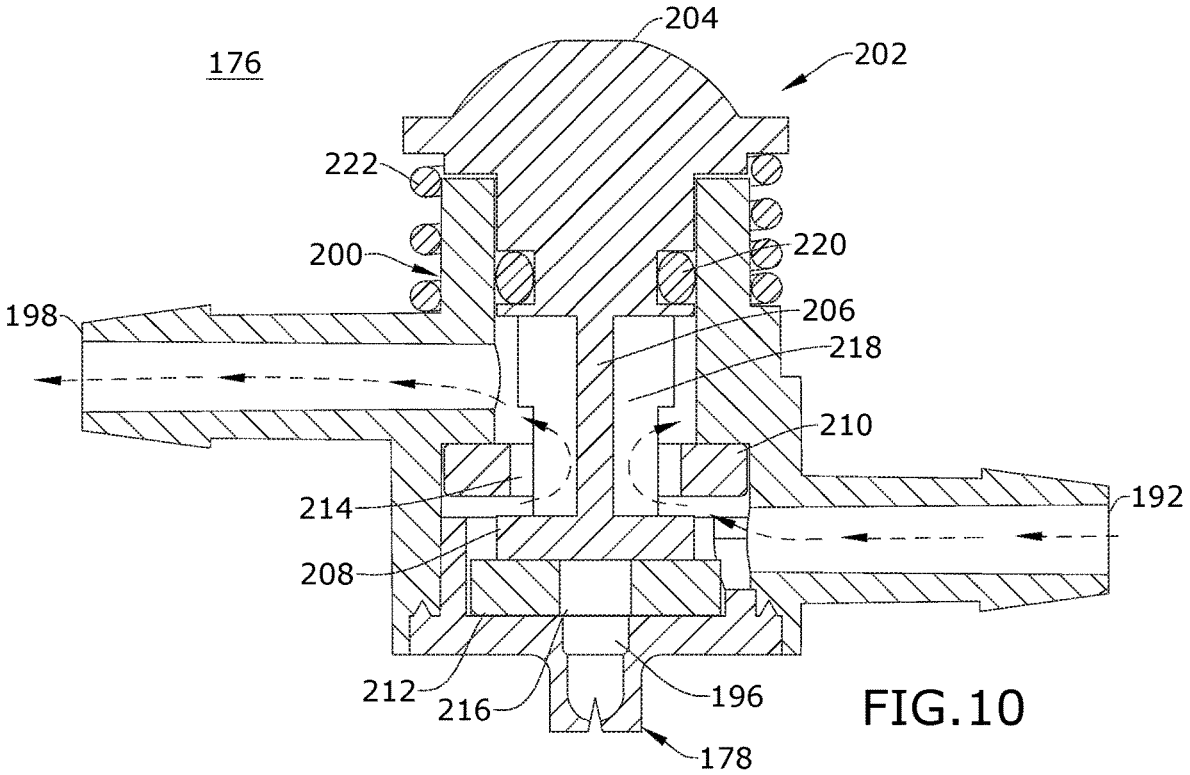
FIG. 10 is a sectional view through a valve assembly of the accessory tool of FIG. 7, showing the valve assembly in a self-cleaning mode.

Referring to FIGS. 9-10, the diverter valve 176 includes a valve inlet or inlet 192 in fluid communication with the source of cleaning fluid, such as via an inlet fluid pathway 194 through the accessory tool 142, and a first outlet 196 in fluid communication with the main fluid distributor 178 and a second outlet 198 in fluid communication with the rinse manifold 180.

The diverter valve can include a valve housing or valve body 200 defining the inlet 192 and outlets 196, 198, and a valve plunger or plunger 202 slidably received within the valve body 200. The plunger 202 includes a head 204 on the exterior of the valve body 200 which is connected by a stem 206 to a plug 208. Upper seal 210 and lower seal 212 are provided within the valve body 200, in a cavity above and below the plug 208. The upper seal 210 and lower seal 212 include a respective upper orifice 214 and lower orifice 216 formed therein. The stem 206 of the plunger 202 can further comprise an X-shaped profile defining reduced diameter portions forming one or more stem channels 218 between the stem 206 and the valve body 200 for passage of fluid around the stem 206. An O-ring 220 can be provided between the plunger 202 and the valve body 200 for a fluid-tight seal at the head 204.

The plunger 202 can move axially within the valve body 200 between a first position shown in FIG. 9 and a second position shown in FIG. 10. The first position (FIG. 9) corresponds to a surface cleaning mode of the accessory tool 142 where the plug 208 is seated against the upper seal 210 and the inlet 192 is open to fluid communication with the first outlet 196 and main fluid distributor 178. The second position (FIG. 10) corresponds to a self-cleaning mode of the accessory tool 142 where the plug 208 is seated against the lower seal 212 and the inlet 192 is open to fluid communication with the second outlet 198 via stem channel 218. A spring 222 mounted between the plunger 202 and valve body 200 can bias the plunger 202 to one of the first and second positions. In the embodiment illustrated, the spring 222 is mounted between a flange 224 on the plunger 202 and a spring seat 226 on the valve body 200, and biases the plunger 202 upwardly to the first position shown in FIG. 9 corresponding to a surface cleaning mode of the accessory tool.

The main fluid distributor 178 can be provided at a bottom side of the valve body 200, rearward of the suction nozzle inlet 152 and elevated or offset above the suction nozzle inlet 152 and surface to be cleaned. In one embodiment, the distributor can comprise a spray tip configured to distribute cleaning fluid in a pressurized fan-shaped spray pattern downwardly onto the surface to be cleaned, rearwardly of a suction nozzle and agitator.

In the illustrated embodiment, the main fluid distributor 178 is formed integrally with the diverter valve 176, and can comprise an insert in the bottom of the valve body 200. In other embodiments, the distributor can be formed separately from the diverter valve 176, and the first outlet 196 of the diverter valve 176 can be in fluid communication with the main fluid distributor 178 via a conduit or other coupling.

The diverter valve 176 can be controlled by the user via a valve actuator, such as a sliding button or diverter slider 228 provided on the main housing 148 to move the diverter valve 176 between the first position (FIG. 9), corresponding to a surface cleaning mode of the accessory tool 142, and the second position (FIG. 10), corresponding to a self-cleaning mode of the accessory tool 142. The diverter slider 228 is configured to selectively engage the plunger 202 of the diverter valve 176 to move the diverter valve 176 to open the inlet 192 to the rinse manifold 180 or to the main fluid distributor 178, respectively.

In the embodiment shown, the diverter slider 228 comprises a ramp 230 on a bottom of the diverter slider 228 for selectively depressing the head 204 of the plunger in self-cleaning mode. When the ramp 230 depresses the plunger 202, the plug 208 on the plunger 202 moves away from the upper seal 210 and seats against the lower seal 212, which opens the fluid path to the second outlet 198 and rinse manifold 180. Optionally, the diverter slider 228 can also include an opening 232 adjacent the ramp 230, which can be in register with, receive, or at least partially accommodate the head 204 of the plunger 202 when the diverter slider 228 is moved into the surface cleaning mode position.

The diverter slider 228 can be operably coupled with a user-engageable actuator, shown herein as a button 234, for moving the diverter slider 228 relative to the diverter valve 176. In the embodiment shown, the diverter slider 228 can be mechanically coupled with the button 234 by a frame 236. The button 234 can conveniently be located on the accessory tool 142 for single-handed operation; in the illustrated example, the button 234 is located on the upper side of the handle grip, such that a user gripping the accessory tool 142 with one hand can use the thumb on that same hand to slide the button 234.

Figure 11:
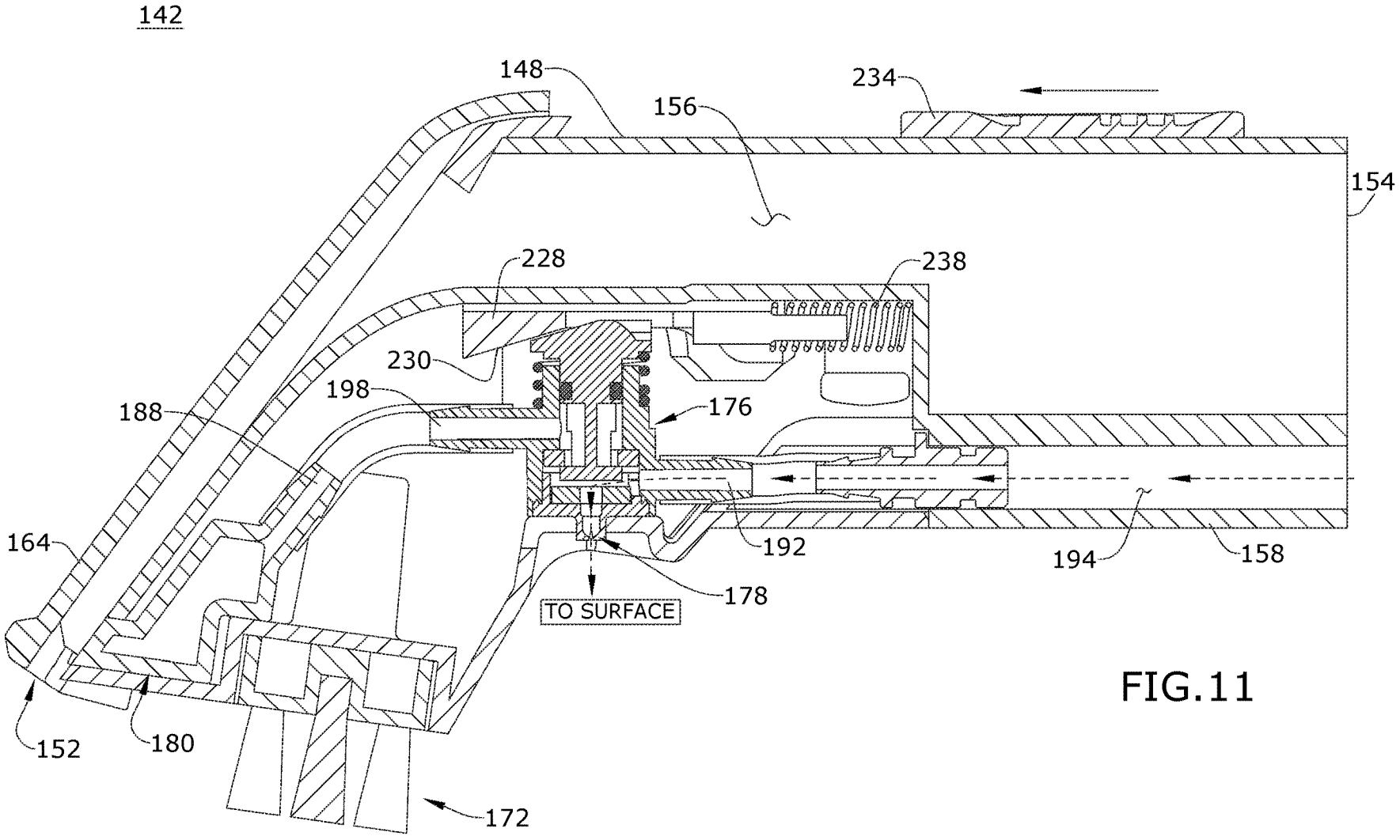
FIG. 11 is a sectional view through the accessory tool of FIG. 7, showing a flow path through the accessory tool in a surface cleaning mode.
Figure 12:
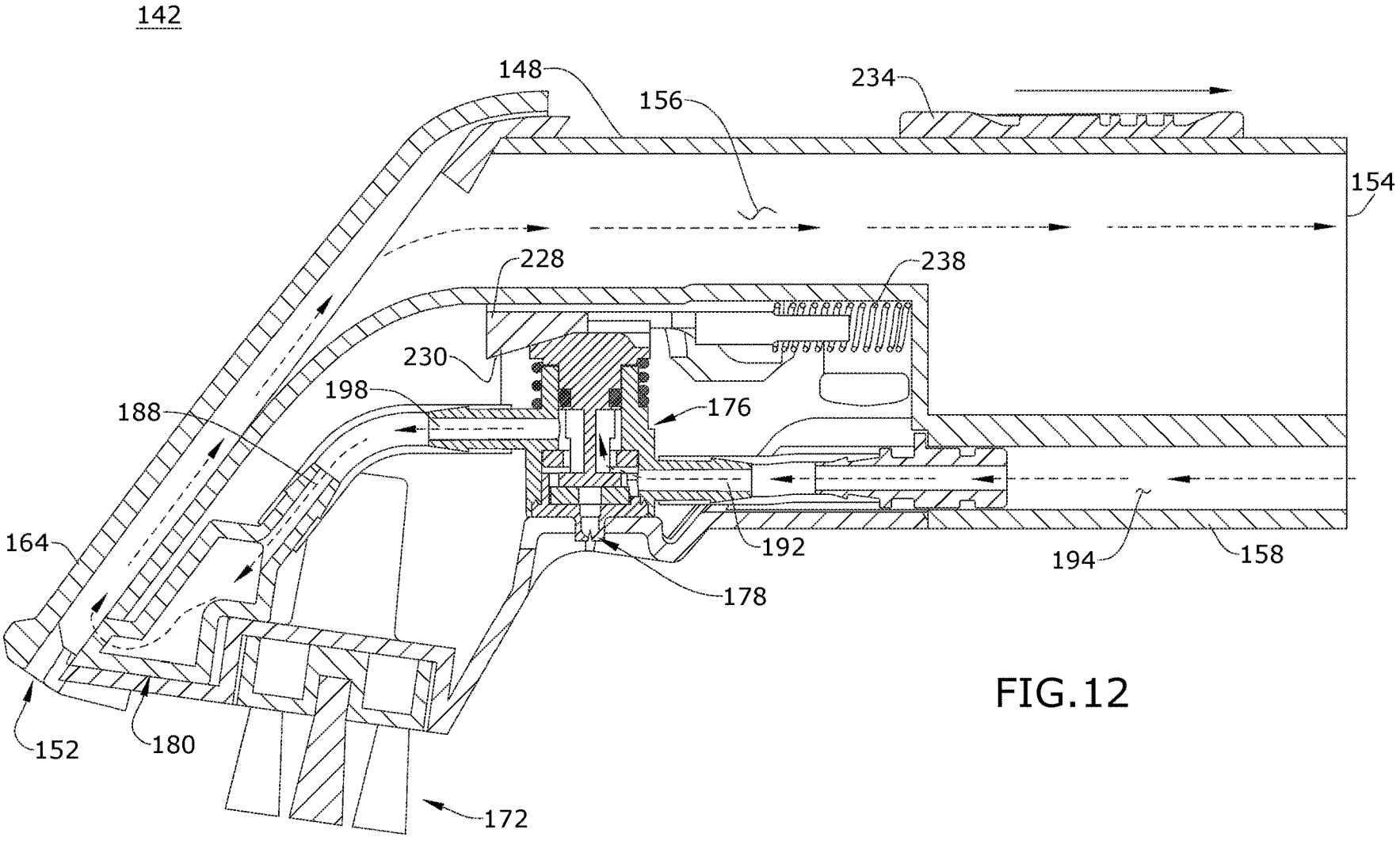
FIG. 12 is a sectional view through the accessory tool of FIG. 7, showing a flow path through the accessory tool in a self-cleaning mode.

The diverter slider 228 can slide within the main housing 148 between a first position shown in FIG. 11, corresponding to a surface cleaning mode of the accessory tool 142, where the diverter valve 176 is in the first position (FIG. 9) and fluid is supplied to the main fluid distributor 178, and a second position shown in FIG. 12, corresponding to a self-cleaning mode of the accessory tool 142, where the diverter valve 176 is in the second position (FIG. 10) and fluid is supplied to the rinse manifold 180. The button 234 can be manipulated by the user to slide the diverter slider 228 between the two positions corresponding to the surface cleaning and self-cleaning modes. As shown herein, the first position of the diverter slider 228 and button 234 can be a forward position, while the second position of the diverter slider 228 and button 234 can be a rearward position, relative to each other and to the suction nozzle 150, which generally can define the front of the accessory tool 142.

A spring 238 can bias the diverter slider 228 to one of the two positions described above. In the embodiment illustrated, the spring 238 biases the diverter slider 228 forwardly within the main housing 148 to the first position (FIG. 11) corresponding to the surface cleaning mode of the accessory tool 142.

Fluid delivery to the accessory tool 142 can be controlled by the user via a first user-engageable actuator or trigger 240 provided on the wand 144. The inlet fluid pathway 194 of the accessory tool 142 couples with a fluid connector 242 of the wand 144. The embodiment of the accessory tool 142 shown herein does not include its own trigger, but rather is controlled via a trigger 240 on the wand 144. In other embodiments of the accessory tool 142, a trigger can be provided on the accessory tool 142 along with a fluid delivery valve controlling liquid flow through the inlet fluid pathway 194 to the diverter valve 176.

In operation, when the diverter slider 228 is in the first or forward position, the accessory tool 142 is in a surface cleaning mode as shown in FIG. 11. The plunger 202 is in its uppermost position (FIG. 9) and the fluid flow path extends from the wand 144 through the inlet fluid pathway 194 in the accessory tool 142, through the diverter valve 176, and out of the main fluid distributor 178. Squeezing the trigger 240 on the wand 144 delivers cleaning fluid to the surface to be cleaned via the main fluid distributor 178.

To switch to the self-cleaning mode shown in FIG. 12, the diverter slider 228 is pulled rearwardly using the button 234 to the second or rearward position, which depresses the plunger 202 (FIG. 10). The plunger 202 moves downwardly and seals the lower orifice 216 to the main fluid distributor 178 and opens the upper orifice 214 to the manifold outlets 184. Squeezing the trigger 240 on the wand 144 delivers cleaning fluid directly to the suction nozzle 150 via the rinse manifold 180. Cleaning fluid flows into the rinse manifold 180, through the manifold outlets 184, and into the suction nozzle passage 168, through the airflow pathway 156, and into the wand 144 and downstream recovery pathway. The cleaning fluid flushes away debris, residue and odor-causing bacteria present in the accessory tool 142, wand 144, accessory hose 146 and downstream fluid recovery pathway, which can be present after normal use.

Figure 13:
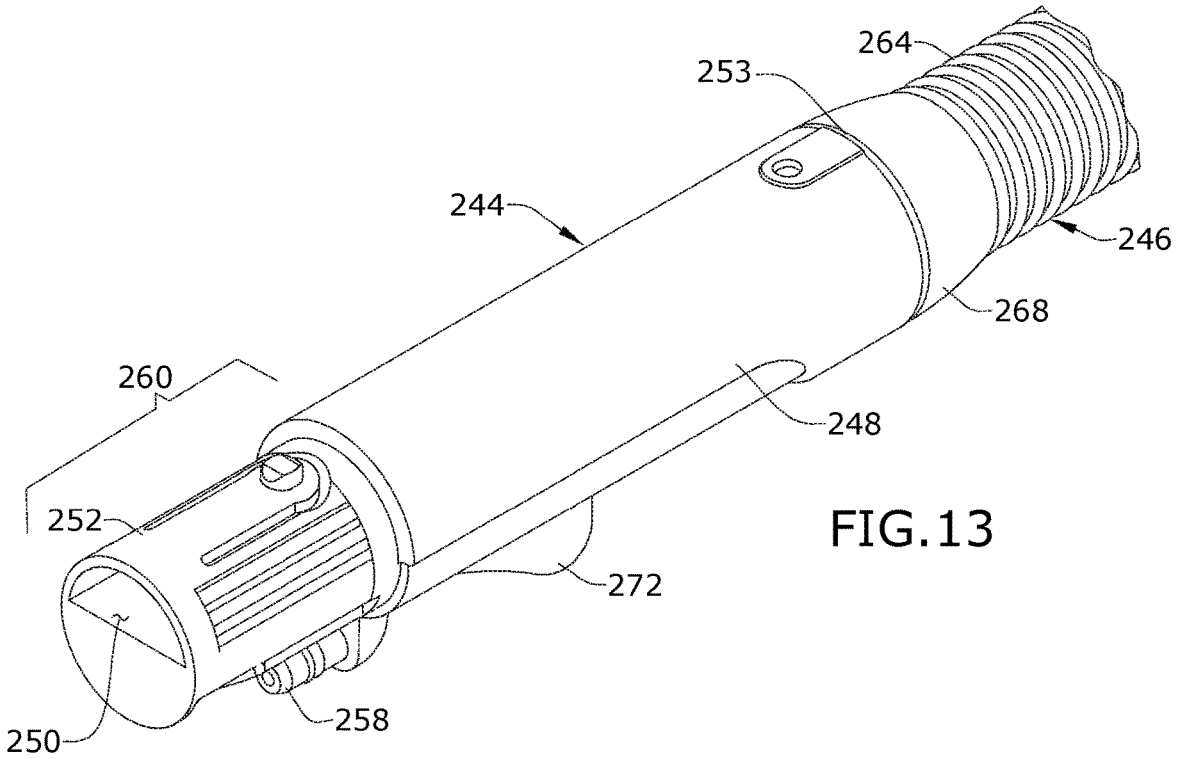
FIG. 13 is a top perspective view of a wand for an accessory hose of an extraction cleaner, according to a fifth aspect of the present disclosure.
Figure 14:
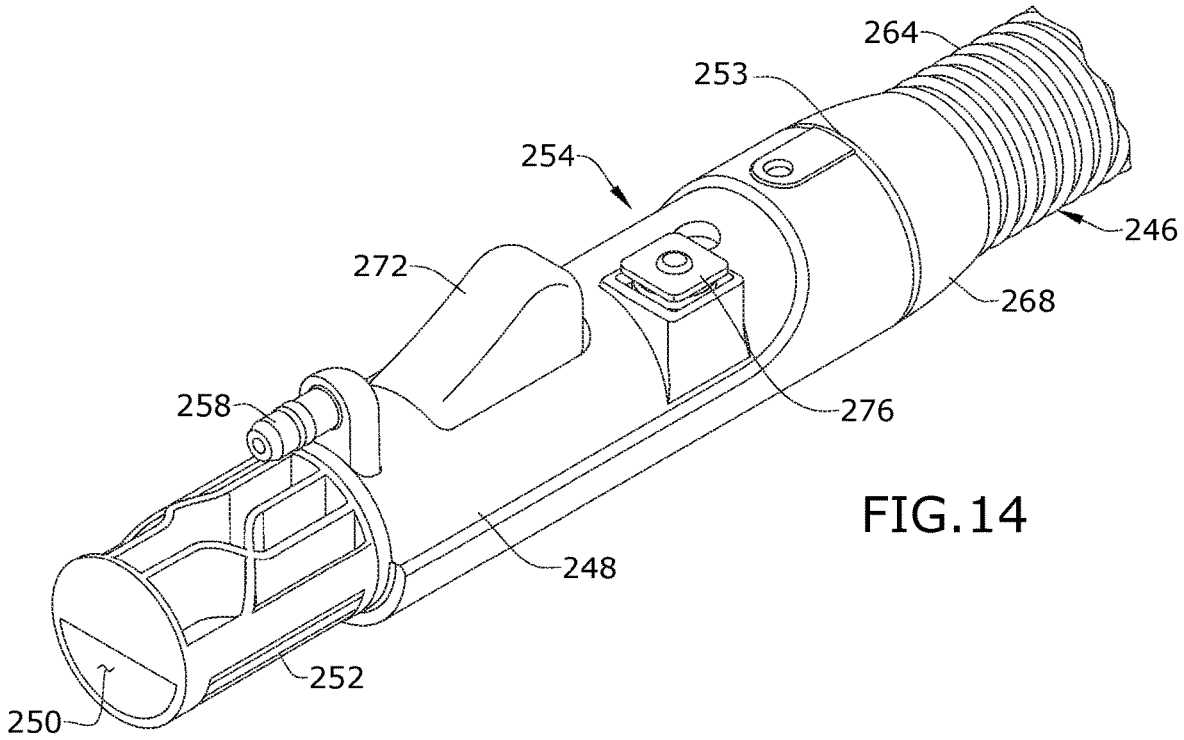
FIG. 14 is a bottom perspective view of the wand of FIG. 13.
Figure 15:
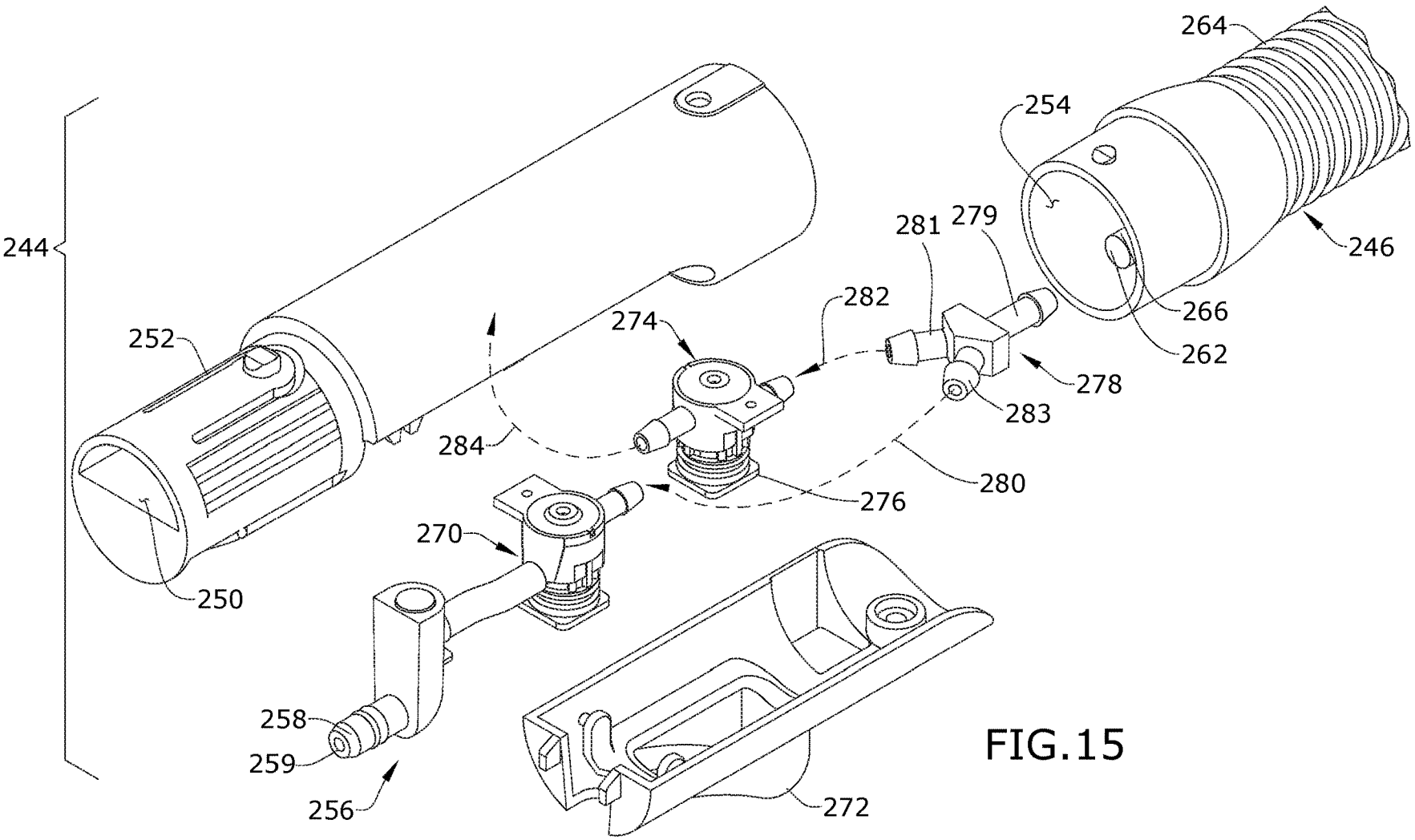
FIG. 15 is an exploded view of the wand of FIG. 13.

FIGS. 13-15 show another embodiment of an accessory for an extraction cleaner, such as the extraction cleaner 10 (FIG. 1). The accessory is illustrated as a wand 244 for the extraction cleaner 10. The wand 244 can be assembled with an accessory hose 246 as shown. The wand 244 is configured to self-clean by selectively diverting cleaning fluid into a working air path of the wand 244 to flush out the wand 244, and will also clean the downstream accessory hose 246. The wand 244 can be configured to fit any standard accessory hose 246. In the context of the extraction cleaner 10 of FIG. 1, the wand 244 can be used as cleaning tool 30 and can couple with accessory hose 28.

The wand 244 includes a wand housing 248, at least a portion of which is tubular. The wand housing 248 includes an airflow pathway 250 having an airflow connector 252 which fluidly couples with an airflow pathway 254 of the accessory hose 246, and a fluid delivery pathway 256 having a fluid connector 258 which fluidly couples with a fluid delivery pathway 262 of the accessory hose 246. The fluid delivery pathway 256 can extend parallel to the airflow pathway 254 at the tubular portion. The airflow connector 252 defines an inlet end of the wand, and the airflow pathway 250 can also include an air outlet 253 configured for fluid communication with the recovery container 20 (FIG. 1). The airflow connector 252 and fluid connector 258 collectively define a wand tool coupler 260 for selectively coupling an accessory cleaning tool (not shown in FIGS. 13-14) to the wand 244. The accessory hose 246 includes a flexible hose conduit 264, a flexible fluid delivery conduit 266, and a hose tool coupler 268 for selectively coupling an accessory tool, such as the wand 244 shown in FIGS. 13-15. The hose tool coupler 268 defines an air inlet or inlet end of the accessory hose 246. Only a portion of the length of the accessory hose 246 is shown in FIGS. 13-15 for clarity, as indicated by the break lines.

A first valve 270 can be provided in the fluid delivery pathway 256 of the wand 244 for controlling the flow of cleaning fluid to the fluid connector 258 defining a fluid outlet 259 of the wand 244. The first valve 270 is normally closed, and can be opened by the user via a first user-engageable actuator, such as a trigger 272 provided on the wand housing 248.

The wand further includes a second valve 274, e.g. an auxiliary fluid flushing valve, configured to direct cleaning fluid into the airflow pathway 250 of the wand 244 to flush out the wand 244, the accessory hose 246, and downstream fluid recovery path. The second valve 274 is normally closed, and can be opened by the user via a second user-engageable actuator, such as a rinsing button 276 provided on the wand housing 248.

The wand 244 can include a Y-connector 278 having a connector inlet 279 defining a fluid inlet, a first connector outlet 281, and a second connector outlet 283. The Y-connector 278 can split the fluid delivery pathway 256 into a first path or conduit 282 which is fluidly connected to the first valve 270 for distributing cleaning fluid onto a surface to be cleaned via the fluid connector 258, and a second path or conduit 282 which is fluidly connected to the second valve 274 for delivering cleaning fluid into the airflow pathway 250 for self-cleaning. The first and second conduits 280, 282 can couple the respective first and second connector outlets 281, 283 to the inlets of the first and second valves 270, 274, respectively. Both the first and second conduits 280, 282 are pressurized by an upstream fluid delivery pump, such as the pump 40 shown in FIG. 1, so that, in operation, a user can distribute cleaning fluid by depressing the trigger 272 which opens the first valve 270. Alternatively, a user can depress the rinsing button 276 which opens the second valve 274. In FIG. 15, the first and second conduits 280, 282 are represented by dashed lines, although it is understood that the conduits 280, 282 may be flexible tubing and/or rigid conduits.

In operation, squeezing the trigger 272 on the wand 244 opens the first valve 270 and delivers cleaning fluid to the fluid connector 258. Pressing the rinsing button 276 on the wand 244 opens the second valve 274 and delivers cleaning fluid into the airflow pathway 250 of the wand 244 to flush out the wand 244, and will also clean the downstream accessory hose 246. A return conduit 284 fluidly connects an outlet of the second valve 274 with the airflow pathway 250, and may include at least one return conduit 284 with an outlet end that is fluidly connected to a fitting or hole (not shown) in the airflow pathway 250 for delivering fluid thereto. In FIG. 15, the return conduit 284 is represented by a dashed line, although it is understood that the return conduit 284 may be a flexible tubing and/or rigid conduits. In this manner, the Y-connector 278 can at least partially form a diverter having the second valve 274 configured to selectively open the return conduit 284.

Figure 16:
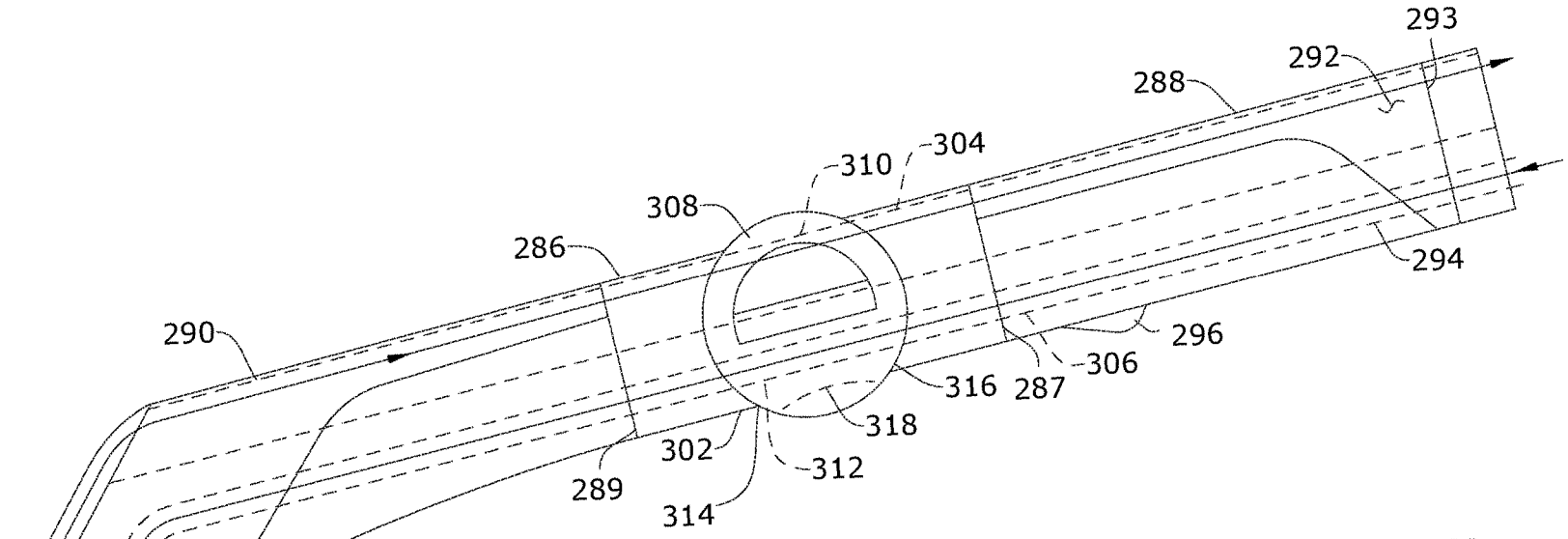
FIG. 16 is a side view of an adapter coupling for a wand and accessory tool of an extraction cleaner, according to a sixth aspect of the present disclosure, showing a diverter of the adapter coupling in a surface cleaning mode.
Figure 17:
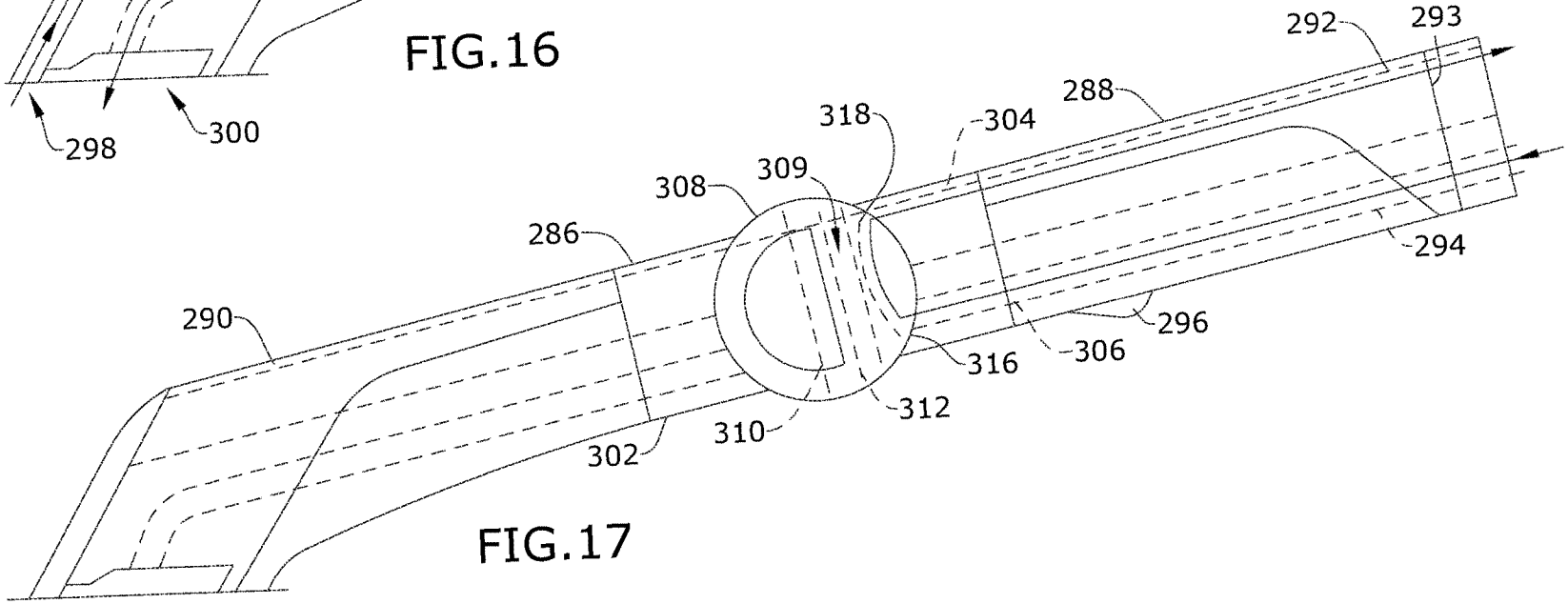
FIG. 17 is a side view of the adapter coupling of FIG. 16, showing a diverter of the adapter coupling in a self-cleaning mode.

FIGS. 16-17 show another embodiment of an accessory for an extraction cleaner, such as the extraction cleaner 10 (FIG. 1). The accessory is shown in the form of an adapter coupling 286 for the extraction cleaner 10 (FIG. 1). The adapter coupling 286 can, for example, be coupled intermediately between a wand 288 and a cleaning tool or accessory tool 290, as shown.

The adapter coupling 286 is configured to self-clean by selectively diverting cleaning fluid into a working air path of the wand 288 to flush out the wand 288, and will also clean a downstream accessory hose (not shown). The adapter coupling 286 can be configured to fit any standard extractor wand or cleaning tool. In the context of the extraction cleaner 10 of FIG. 1, the adapter coupling 286 can be coupled intermediately between the accessory hose 28 and the cleaning tool 30.

The wand 288 has at least an airflow pathway 292 and a fluid delivery pathway 294, as well as a trigger 296 for controlling the flow of cleaning fluid through the fluid delivery pathway 294. The accessory tool 290 has at least an air inlet in the form of a suction nozzle inlet 298 in fluid communication with the airflow pathway 292 and a fluid distributor 300 in fluid communication with the fluid delivery pathway 294. The adapter coupling 286 has a fluid inlet 287 and a fluid outlet 289 and is configured to selectively fluidly connect the airflow pathway 292 and fluid delivery pathway 294 of the wand 288 with the suction nozzle inlet 298 and fluid distributor 300, respectively, of the accessory tool 290. The airflow pathway 292 can also include an air outlet 293 configured for fluid communication with the recovery container 20 (FIG. 1).

The adapter coupling 286 comprises a housing 302 defining a working air conduit 304 and a fluid delivery conduit 306. A portion of the working air and fluid delivery conduits 304, 306 is provided by a moveable diverter 308 provided on the housing 302. The diverter 308 can be rotatably mounted to the housing 302, for example, rotatably mounted at the center of the housing 302. The diverter 308 can carry or otherwise be provided with a rotatable section 310 of the working air conduit 304 and a rotatable section 312 of the fluid delivery conduit 306.

The diverter is moveable between a first position shown in FIG. 16 and a second position shown in FIG. 17. In the first position of FIG. 16, the fluid delivery conduit 306 in the diverter 308 is aligned and in fluid communication with the corresponding pathways in wand 244 and accessory tool 290. Cleaning fluid can be delivered through the wand 288, adapter coupling 286, and accessory tool 290, and onto the surface to be cleaned via the fluid distributor 300. Also, in the first position the working air conduit 304 in the diverter 308 is aligned and in fluid communication with the corresponding pathways in wand 244 and accessory tool 290, and working air can be pulled through the accessory tool 290, adapter coupling 286, and wand 288, via the suction nozzle inlet 298. The mating junctions between the rotatable sections 310, 312 of the working air conduit 304 and/or fluid delivery conduit 306 formed in the diverter 308 and the portion of the conduits 304, 306 formed in the housing 302 can further comprise seals 314, 316 to minimize air and/or liquid leaks when in the first position. As shown herein, seals 314, 316 are provided between the rotatable sections 310, 312 of the working air 304 and fluid delivery 306 conduits and the portions formed in the housing 302. In one example, the seals 314, 316 can be carried by the housing 302.

In the second position of FIG. 17, the fluid delivery conduit 306 in the diverter 308 is misaligned and out of fluid communication with the corresponding pathways in the wand 288 and accessory tool 290. Instead, the diverter 308 is positioned to divert cleaning fluid into the airflow pathway 292 of the wand 288 downstream of the suction nozzle inlet 298 and upstream of the air outlet 293 to flush out the wand 288 and also clean the downstream accessory hose. Also in the second position, the working air conduit 304 in the diverter 308 is misaligned and out of in fluid communication with the corresponding pathways in the wand 288 and accessory tool 290.

The diverter 308 can be in the form of a rotary valve or fluid deflector 318, which can comprise an arcuate wall near the perimeter of the diverter 308, for deflecting cleaning fluid from the fluid delivery pathway 294 into the airflow pathway 292 of the wand 288. The fluid deflector 318 can be configured to join a portion of the fluid delivery conduit 306 formed in the housing 302 with a portion of the working air conduit 304 formed in the housing 302. The mating junctions between the portions of the fluid deflector 318 formed in the diverter 308 and the portion of the conduits 304, 306 formed in the housing 302 can further comprise seals (not shown) to minimize liquid leaks when in the second position. In this manner, when the fluid deflector 318 is in the first position the working air conduit 304 is in register with the air inlet or suction nozzle inlet 298 and the air outlet 293, and the fluid delivery conduit 306 is in register with the fluid inlet 287 and fluid outlet 289.

To rinse the wand 288, a user rotates the diverter 308 from the first position shown in FIG. 16 to the second position shown in FIG. 17, for example 90 degrees counterclockwise, which disconnects the working air conduit 304 and fluid delivery 306 conduit and aligns the fluid deflector 318 with the fluid delivery conduit 306. In this second position, the fluid deflector 318 defines a return conduit 309 in register with the fluid inlet 287 and the air outlet 293. Next, the user depresses the trigger 296 to distribute cleaning fluid from the wand 288. The stream of cleaning fluid hits the arcuate wall forming the fluid deflector 318 and is guided upwardly and rearwardly, into the working air path of the wand 288, where it is entrained in the airflow pathway 292 and carried through the accessory hose and downstream working air path, rinsing debris and contaminates off the surfaces it contacts.

There are several advantages of the present disclosure arising from the various features of the apparatus described herein. For example, the aspects of the present disclosure described above provide self-cleaning features for extraction cleaners and attachments for extraction cleaners, such as accessory tools, wands, and/or hoses. Users of extraction cleaners often find that the cleaning process is messy, including the effort needed to keep the extraction cleaner and associated attachments in good working order. Unpleasant odors may develop over time, particularly in the accessory hose. The various self-cleaning features disclosed in the embodiments described herein help users easily keep their extraction cleaner and associated attachments clean after use.

To the extent not already described, the features and structures of the various embodiments of the extraction cleaners, systems, and methods may be used in combination with each other as desired. That one feature may not be illustrated in all of the embodiments is not meant to be construed that it cannot be, but is done for brevity of description. For example, the wand caps of FIGS. 2-5 can be used with any of the wands disclosed herein, the wand receiver of FIGS. 6A-6B can be provided on any of the extraction cleaners disclosed herein and/or used with any of the wands disclosed herein, the accessory tool of FIGS. 7-12 can couple with any of the wands disclosed herein, and the adapter coupling of FIGS. 16-17 can couple with any of the tools or wands disclosed herein. Still further, while the extraction cleaners shown herein deliver liquid cleaning fluid to the surface to be cleaned, aspects of the invention may also be incorporated into other extraction cleaning apparatus, such as extraction cleaning apparatus with steam delivery instead of or in addition to liquid delivery. Thus, the various features of the embodiments disclosed herein may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

It is intended that the following concepts can define at least a portion of the scope of the disclosure and that the apparatus and/or method(s) within the scope of these concepts and their equivalents be covered thereby. This disclosure should be understood to include all novel and non-obvious combinations of elements described herein, and the concepts may be presented in this or a later application to any novel and non-obvious combination of these elements. Any aspect of any embodiment can be combined any aspect of any of the other embodiments. Moreover, the foregoing embodiments are illustrative, and no single feature or element is essential to all possible combinations that may be included in this or a later application. For example, other inventions arising from this disclosure may include any combination of the following concepts set forth below:

The accessory as described herein wherein the diverter comprises a plunger valve comprising a valve body defining a valve inlet in fluid communication with the fluid inlet, a first outlet in fluid communication with a distributor and a second outlet in fluid communication with a rinse manifold, and a valve plunger slidably received within the body.

The accessory as described herein, further comprising a return conduit extending through the housing from the fluid delivery pathway to the airflow pathway, wherein the diverter comprises a valve configured to selectively open the return conduit.

The accessory as described herein wherein the diverter comprises a rotary valve having a working air conduit, a fluid delivery conduit, and a return conduit, wherein the rotary valve is moveable between a first position in which the working air conduit is in register with the air inlet and the air outlet, and in which the fluid delivery conduit is in register with the fluid inlet and the fluid outlet, and a second position in which the return conduit is in register with the fluid inlet and the air outlet.

The accessory as described herein wherein the accessory comprises an accessory tool and the accessory tool comprises a suction nozzle defining the air inlet and a distributor defining the fluid outlet.

The accessory as described herein wherein the suction nozzle is at a forward portion of the housing and the air outlet is at a rearward portion of the housing.

The accessory as described herein wherein the housing comprises a conduit forming a handle for holding the accessory tool, and the airflow pathway is at least partially defined by the conduit.

The accessory as described herein wherein the accessory tool comprises an agitator provided on the housing and located rearwardly of the suction nozzle.

The accessory as described herein wherein the accessory tool further comprises a rinse manifold having at least one outlet in fluid communication with the airflow pathway downstream of the air inlet and upstream of the air outlet, and wherein the diverter comprises a valve configured to selectively divert fluid through the distributor or through the rinse manifold.

The accessory as described herein wherein the rinse manifold comprises a spray bar having a plurality of outlets in fluid connection with the suction nozzle.

The accessory as described herein wherein the housing comprises a manifold opening at a lower end of the suction nozzle, and the plurality of outlets are aligned with the manifold opening.

The accessory as described herein wherein the diverter comprises a valve having a valve inlet in fluid communication with the fluid inlet, a first outlet in fluid communication with the distributor and a second outlet in fluid communication with the rinse manifold.

The accessory as described herein wherein the distributor is formed integrally with the valve and is provided at a bottom of the valve, rearward of the suction nozzle.

The accessory as described herein, further comprising a valve actuator provided on the housing and operably coupled to the valve, wherein the valve actuator comprises a sliding button on the housing.

The accessory as described herein wherein the valve actuator further comprises a ramp operably coupled with the sliding button and in register with a plunger of the valve.

The accessory as described herein wherein the accessory comprises a wand, and the wand comprises a tool coupler having an airflow connector defining the air inlet, and a fluid connector defining the fluid outlet.

The accessory as described herein, further comprising a return conduit extending through the housing from the fluid delivery pathway to the airflow pathway, wherein the diverter is configured to divert cleaning fluid into the return conduit.

The accessory as described herein, further comprising a first valve in the fluid delivery pathway upstream of the fluid connector and wherein the diverter comprises a second valve between the fluid delivery pathway and the return conduit.

The accessory as described herein, further comprising a first user-engageable actuator provided on the housing and operably coupled to the first valve and a second user-engageable actuator provided on the housing and operably coupled to the second valve.

The accessory as described herein wherein the first user-engageable actuator comprises a trigger and the second user-engageable actuator comprises a button.

The accessory as described herein, further comprising a Y-connector having a connector inlet defining the fluid inlet, a first connector outlet fluidly connected to the first valve, and a second connector outlet fluidly connected to the second valve.

The accessory as described herein, wherein the accessory comprises an adapter coupling configured to be coupled intermediately between a wand and an accessory tool.

The accessory as described herein wherein the diverter is rotatably mounted to the housing and carries a working air conduit forming a portion of the airflow pathway and a fluid delivery conduit forming a portion of the fluid delivery pathway.

The accessory as described herein wherein the diverter is moveable between a first position in which the working air conduit is in register with the air inlet and the air outlet, and in which the fluid delivery conduit is in register with the fluid inlet and the fluid outlet, and a second position in which the working air conduit is out of register with the air inlet and the air outlet, and in which the fluid delivery conduit is out of register with the fluid inlet and the fluid outlet.

The accessory as described herein wherein the diverter comprises a fluid deflector, wherein in the second position of the diverter, the fluid deflector is in register with the fluid inlet and the air outlet.

The accessory as described herein wherein the diverter comprises a fluid deflector configured to deflect cleaning fluid from the fluid inlet to the airflow pathway downstream of the air inlet and upstream of the air outlet.

The accessory as described herein wherein the fluid deflector comprises an arcuate wall.

What is claimed is:

1. A system for cleaning a recovery path of an extraction cleaner having a fluid delivery system comprising a supply container and a recovery system comprising at least a suction source and a recovery container, the system comprising:

a wand, comprising:

a fluid delivery pathway adapted for fluid communication with the supply container and having a fluid connector; and an airflow pathway adapted for fluid communication with the recovery container having an airflow connector; and a wand cap adapted to partially receive the wand and comprising:

a fluid connector receiver that mates with the fluid connector of the wand;

an airflow connector receiver that mates with the airflow connector of the wand; and an enclosed pathway between the fluid connector receiver and the airflow connector receiver.

2. The system of claim 1 wherein the wand comprises a wand housing with a first end adapted to selectively couple an accessory cleaning tool and a second end opposite the first end, wherein the fluid connector and the airflow connector are provided at the first end.

3. The system of claim 2 wherein the wand cap fits on the first end of the wand housing.

4. The system of claim 1 wherein the enclosed pathway comprises a first internal fluid channel in fluid communication with the fluid connector receiver and a second internal fluid channel in fluid communication with the airflow connector receiver.

5. The system of claim 4 wherein the wand cap further comprises a wall separating the first internal fluid channel and the second internal fluid channel, and at least one passage opening provided in the wall.

6. The system of claim 1 wherein the wand cap comprises a cap housing having a closed end wall and a peripheral side wall extending from the closed end wall to an open opposite end in which the wand is received.

7. The system of claim 6 wherein the wand cap further comprises at least one air vent formed in the cap housing and in fluid communication with the enclosed pathway.

8. The system of claim 6 wherein at least a portion of the cap housing is transparent.

9. The system of claim 1 wherein the wand cap further comprises a hose clip configured to clip onto an accessory hose of the extraction cleaner for storage.

10. The system of claim 1, further comprising an accessory hose coupled with the wand and comprising:

a flexible fluid delivery conduit in fluid communication with the fluid delivery pathway; and a flexible hose conduit in fluid communication with the airflow pathway.

11. The system of claim 10 wherein the wand cap further comprises a hose clip configured to clip onto an accessory hose of the extraction cleaner for storage.

12. The system of claim 1, further comprising the extraction cleaner wherein the wand cap is provided on the extraction cleaner.

13. The system of claim 12 wherein the wand cap comprises a wand receiver on a housing of the extraction cleaner.

14. The system of claim 1 wherein the wand comprises a valve in the fluid delivery pathway for controlling the flow of cleaning fluid to the fluid connector and a trigger operably coupled with the valve.

15. The system of claim 1 wherein the wand comprises a detent and the wand cap comprises a detent opening configured to receive the detent to secure the wand cap to the wand.

* * * * *